US007029315B2

(12) United States Patent
Dang

(10) Patent No.: US 7,029,315 B2
(45) Date of Patent: Apr. 18, 2006

(54) ELECTRICAL CONNECTOR ASSEMBLY WITH RECONFIGURABLE STRAIN RELIEF

(75) Inventor: Phong T. Dang, Kent, WA (US)

(73) Assignee: Carlyle, Inc., Tukwila, WA (US)

( * ) Notice: Subject to any disclaimer, the term of this patent is extended or adjusted under 35 U.S.C. 154(b) by 0 days.

(21) Appl. No.: 10/764,402

(22) Filed: Jan. 23, 2004

(65) Prior Publication Data

US 2005/0164543 A1 Jul. 28, 2005

(51) Int. Cl.
*H01R 13/56* (2006.01)

(52) U.S. Cl. ..... 439/468; 439/676

(58) Field of Classification Search ..... 439/468, 439/449, 472–4, 713, 676
See application file for complete search history.

(56) References Cited

U.S. PATENT DOCUMENTS 3,622,943 A * 11/1971 Reimer ..... 439/472
4,653,832 A * 3/1987 Sanchez ..... 439/465
4,761,145 A 8/1988 Goto et al.
4,869,686 A 9/1989 Michaels et al.
5,076,802 A 12/1991 Colleran et al.
5,385,484 A 1/1995 Bartle et al. ..... 439/468
5,695,358 A 12/1997 Myer et al.
5,890,926 A 4/1999 Pauza et al. ..... 439/445

* cited by examiner

*Primary Examiner*—P. Austin Bradley
*Assistant Examiner*—Edwin A. Leon
(74) *Attorney, Agent, or Firm*—Stoel Rives LLP

(57) ABSTRACT

An electrical connector assembly comprises a main housing section and a strain relief member that is selectively connected to the main housing in one of a plurality of predetermined angularly offset positions each defining a corresponding exit path for a wire or cable that extends through the strain relief member and into the main housing section to terminate at a connector body of the electrical connector assembly, which is supported on the main housing section opposite the strain relief member. The main housing section and the strain relief member may be formed of a die-cast or molded electrically conductive material and may be closely mated together to shield the connector body and/or the wires from electro-magnetic interference (EMI).

30 Claims, 3 Drawing Sheets

38
30
48
56
20
68
174
60
134
34
44
176
42
176
24
68
174
64
54
52
10
36
38

52
30
10
34
94
64
102
86
36
114
54
104
64
60
110
162
164
56
148
42
138
66
44
36
42
20

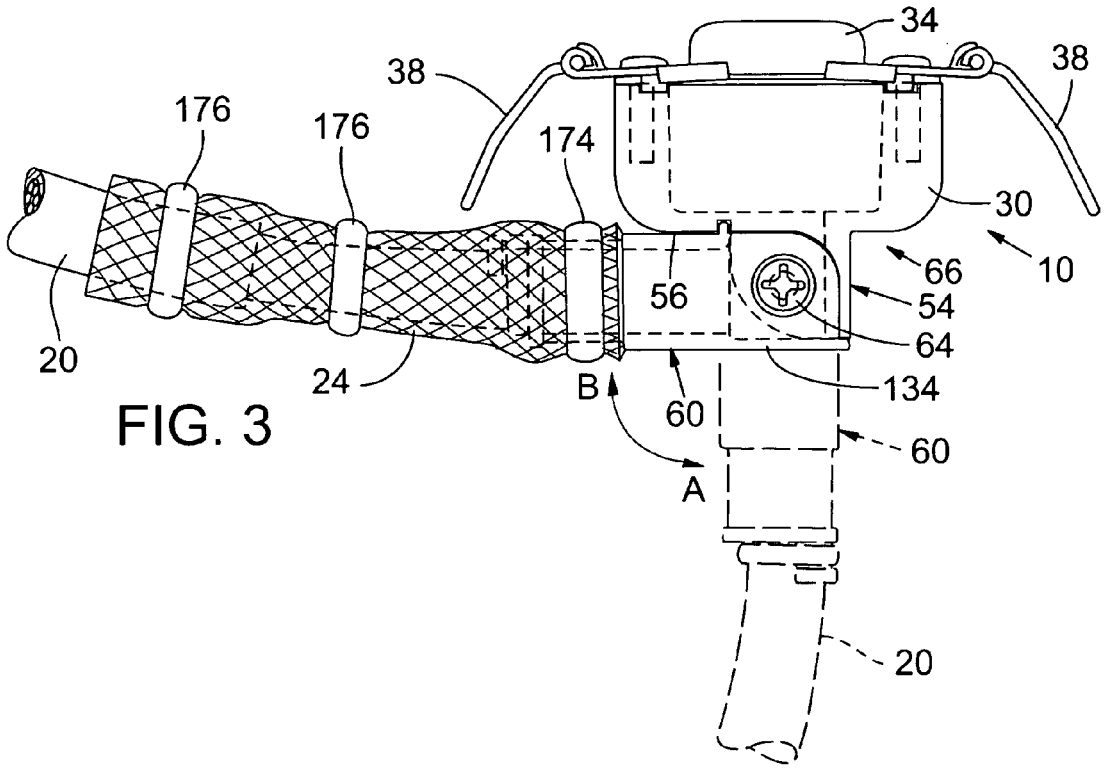
FIG. 3
FIG. 4A
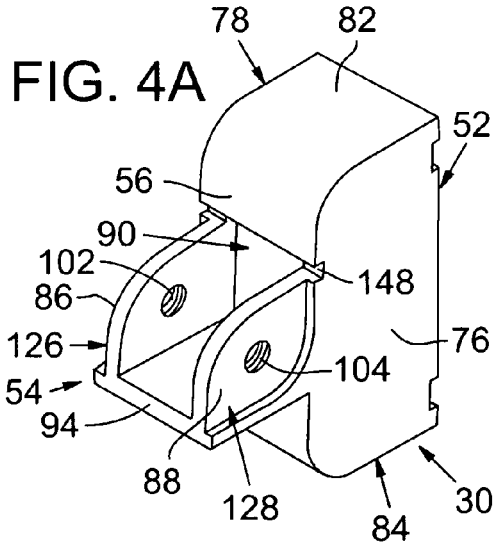
FIG. 4B
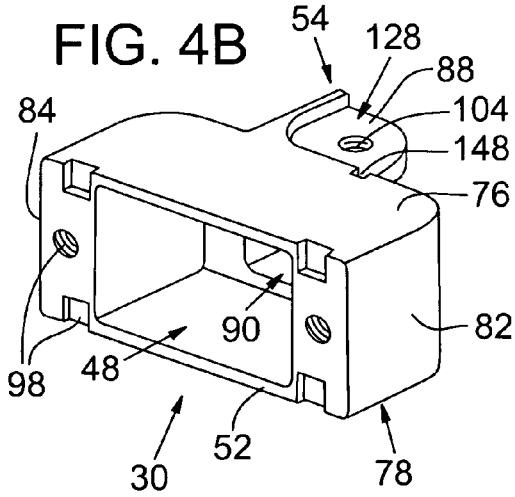

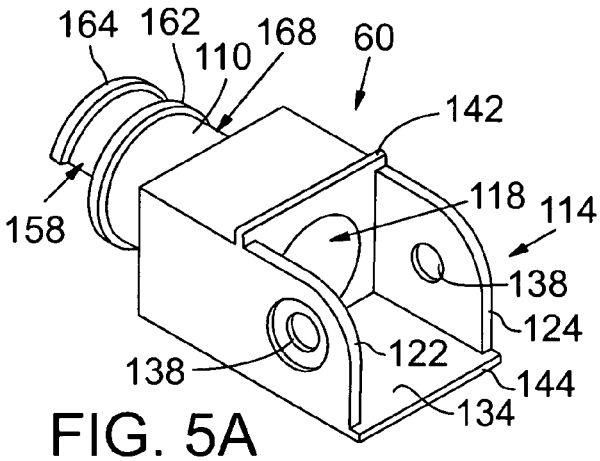
FIG. 5A
FIG. 5B
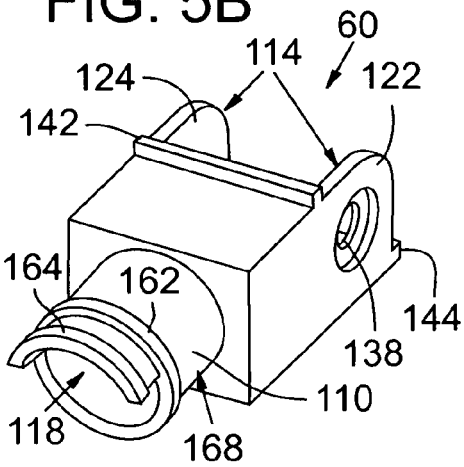
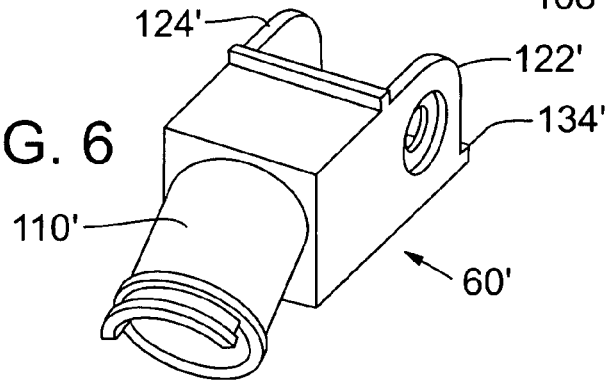
FIG. 6
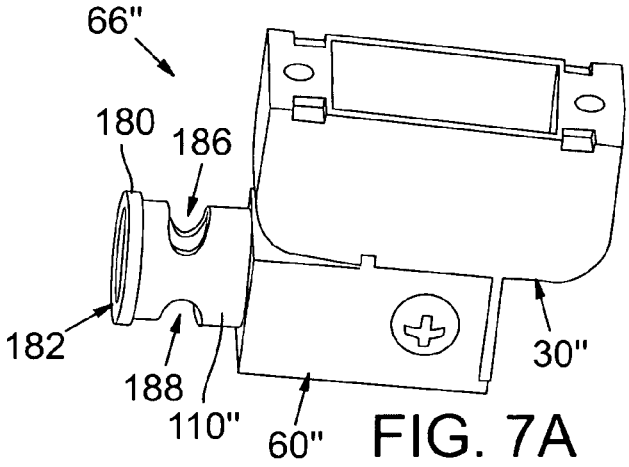
FIG. 7A
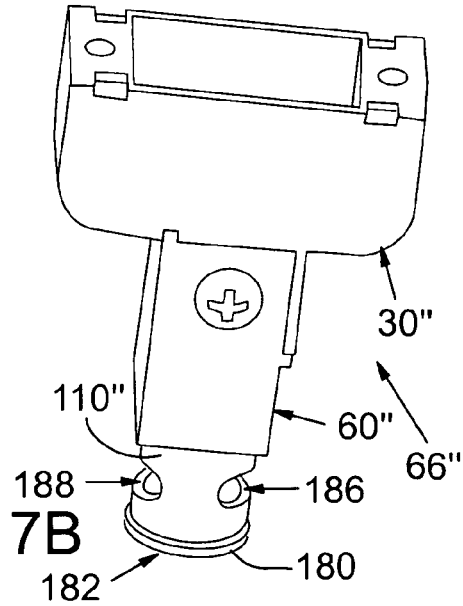
FIG. 7B

ELECTRICAL CONNECTOR ASSEMBLY WITH RECONFIGURABLE STRAIN RELIEF

TECHNICAL FIELD

This application relates to electrical connector assemblies of the type including a housing with a strain relief member for supporting a wire or cable terminated by the connector.

BACKGROUND OF THE INVENTION

It is well known to provide housings for electrical connectors to which a plurality of wires are terminated. Such housings typically include an opening through which the wires, or a cable comprising such wires, passes and where a strain relief member clamps the wires or cable to prevent the wires from being pulled loose from the connector. Some such housings are made of metal to help shield the conductors and the connector from electromagnetic interference (EMI).

U.S. Pat. No. 4,549,780 of Bertini et al. and U.S. Pat. No. 4,761,145 of Goto et al. describe electrical connector housings that can be configured to allow a cable to extend from the connector in one of two different directions-straight or angled. The housings have a clamshell structure, with opposing sections joined together over the connector and secured together about their peripheries by several screws. The connectors are configured to allow a cable to pass through one of two possible openings in the housing. In each connector housing, a strain relief clamp is slidably mounted to bear against a side of the cable and clamp the cable against an opposing side surface of the opening. The other (unused) of the two openings is covered by a plug or plate. The connector housings of Bertini et al. and Goto et al. are expensive to manufacture and assemble because they have a large number of components—many of which are small and difficult to manipulate. The number of parts can also lead to increased problems with EMI, due to gaps and irregularities in various parts of the housing.

The present inventor has recognized a need for an improved electrical connector assembly with a housing that can be easily reconfigured between multiple cable exit paths and the desirability for such a housing to have good EMI shielding properties.

SUMMARY OF THE INVENTION

An electrical connector assembly comprises a main housing section for supporting a connector body to which a wire or cable is terminated. The main housing section has a terminal end at which the connector may be coupled to another connector or electronic device. A strain relief member is preferably connected to a mounting flange of the main housing section, which extends from the main housing section opposite its terminal end. The strain relief member includes a passage sized to admit the wire or cable therethrough and is selectively connected to the main housing section in one of a plurality of predetermined discrete, angularly offset positions each defining a corresponding exit path for the wire or cable. Preferably, the strain relief member can be selectively reconfigured between at least two angularly offset positions relative to the main housing section without decoupling the main housing section from the connector body.

The main housing section preferably includes an opening that allows the wire or cable to enter the main housing section from a plurality of angularly offset directions. And the strain relief member preferably includes a cover section that extends over the unused portion of the one or more openings not intersected by the cable path.

The main housing section and the strain relief member may be formed of a die-cast or molded electrically conductive material, such as ZAMAK-3 zinc alloy, to shield the connector body from electromagnetic interference (EMI). The mounting flange of the main housing may include a pair of parallel flange walls and the strain relief member may include a pair of nesting walls that overlap with the flange walls and cooperate to surround the cable at the junction between the main housing and the strain relief member, to thereby enhance EMI shielding properties.

Additional aspects and advantages of the invention will be apparent from the following detailed description of preferred embodiments, which proceeds with reference to the accompanying drawings.

BRIEF DESCRIPTION OF THE DRAWINGS

FIG. 3 is a top view of the cable assembly of FIG. 1 with the strain relief member of the electrical connector assembly configured in an alternate position so that the cable follows a right-angle exit path;

FIGS. 4A and 4B are first and second enlarged isometric views of the main housing section of the electrical connector assembly of FIGS. 1–3, showing details of respective cable-receiving and terminal ends of the main housing section;

FIGS. 5A and 5B are first and second enlarged isometric views of the strain relief member of the connector housing of FIGS. 1–3;

FIG. 6 is a pictorial view of an alternative strain relief member including an angled cable-receiving neck portion; and FIGS. 7A and 7B are first and second pictorial views of a housing for an electrical connector assembly in accordance with another alternative embodiment, with a strain relief member of the housing shown in respective first and second positions defining corresponding right-angle and straight cable exit paths.

DETAILED DESCRIPTION OF PREFERRED EMBODIMENTS

Figure 1:
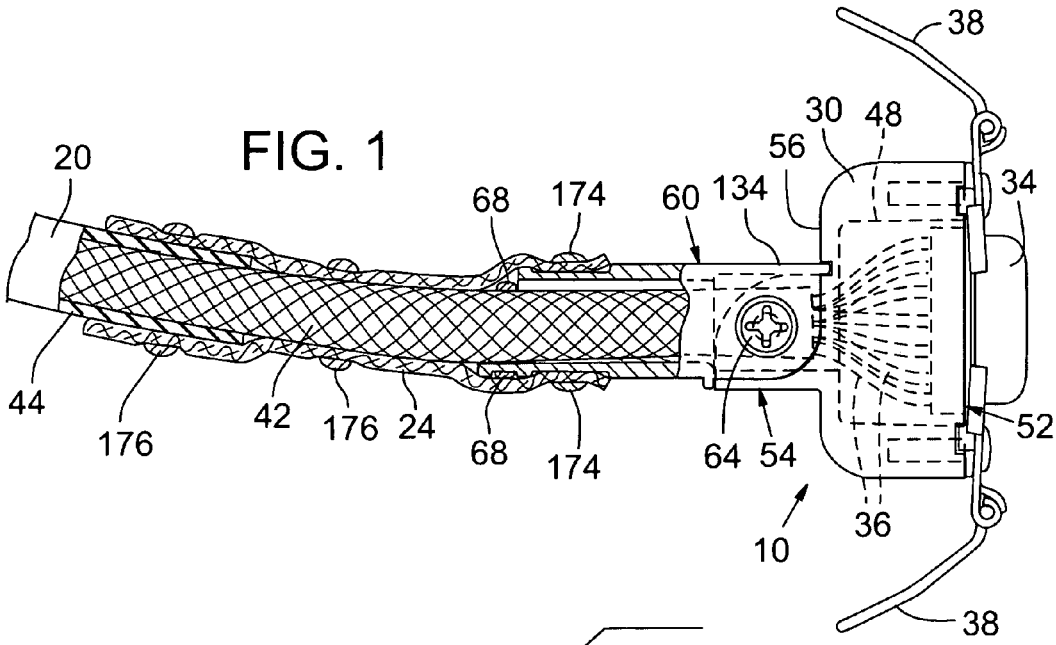
FIG. 1 is a top view of an electrical connector assembly to which a cable is terminated in accordance with a preferred embodiment.
Figure 2:
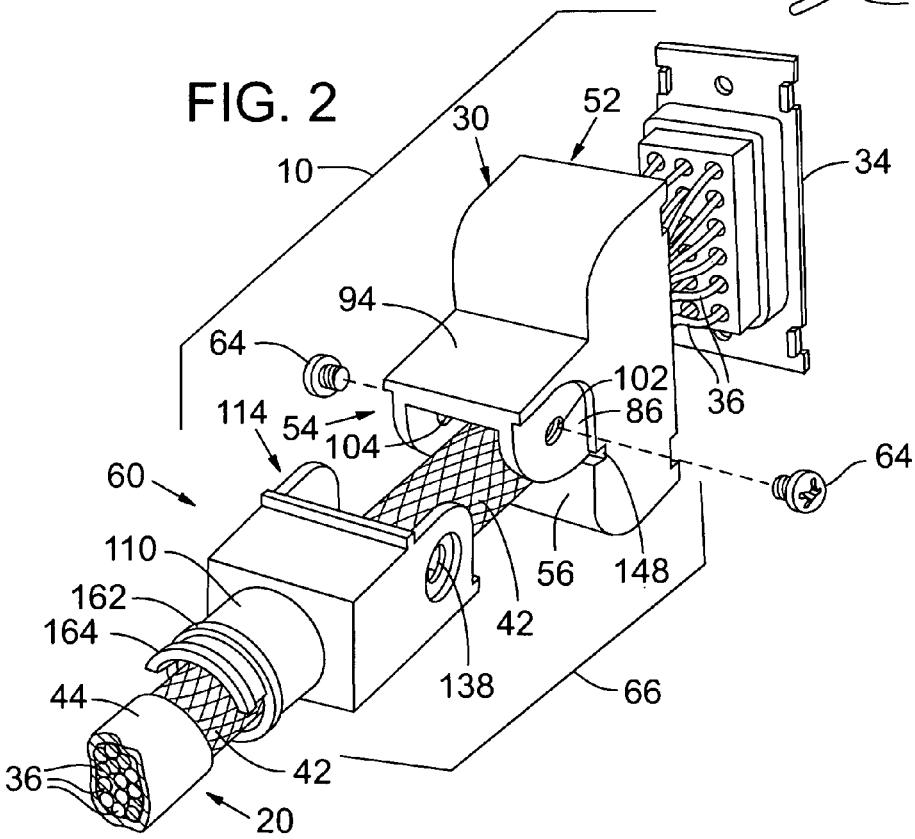
FIG. 2 is an exploded assembly view of the cable and electrical connector assembly of FIG. 1, showing a main housing section, a strain relief member, and connector body (with latch bails omitted) to which a plurality of wires of the cable are terminated.

FIG. 1 is a top view of an electrical connector assembly 10 to which a cable 20 is terminated in accordance with a preferred embodiment. FIG. 2 is an exploded assembly view of the electrical connector assembly 10 and cable 20 of FIG. 1, with a braided sleeve shield 24 of FIG. 1 omitted to show details of electrical connector assembly 10. With reference to FIGS. 1 and 2, electrical connector assembly 10 includes a main housing section 30 supporting a connector body 34 that includes at least one electrical contact (not shown) for terminating one or more wires 36 of cable 20. A pair of optional latch bails 38 are shown attached to connector body 34 in FIG. 1, but omitted from FIG. 2. Skilled persons will appreciate that connector body 34 may comprise any of a variety of types of electrical connectors, such as subminiature D (D-Sub) connectors, DIN connectors, and other types of electrical connectors for terminating wires or cables. Electrical connector assembly 10 and, in particular, main housing section 30 and connector body 34 may be provided in a variety of sizes, depending on the number of contacts needed in connector body 34. For example, D-Sub connectors are commonly made in a variety of sizes including 15-pin, 25-pin, 62-pin, and many other sizes. The number and density of contacts in connector body 34 will impact the overall proportions of electrical connector assembly 10, including main housing section 30 and a strain relief member 60 of electrical connector assembly 10. Connector body 34 is preferably seated at least partly in a cavity 48 formed in main housing section 30 along a terminal end 52 thereof. Connector body 34 may optionally be secured to main housing section 30 with fasteners or otherwise, as further described below with reference to FIGS. 4A and 4B.

Skilled persons will also appreciate that cable 20 may include one or more conductor wires 36 that are individually insulated and which may be shielded by a braided sheath 42 protected by an outer insulating layer 44. In other embodiments (not shown), electrical connector assembly 10 is used to terminate multiple, separately shielded and insulated wires and/or cables, which extend through main housing section 30 and into connector body 34.

Main housing section 30 further includes a mounting flange 54 projecting from a wire-receiving end 56 of main housing section 30 opposite terminal end 52. Strain relief member 60 is mated with mounting flange 54 and secured to main housing section 30 via a pair of screws 64. Collectively, main housing section 30 and strain relief member 60 comprise a housing 66 of electrical connector assembly 10. Cable 20 is lashed to strain relief member 60 via a string tie 68 (FIG. 1) or other tie or band to prevent tension on cable 20 from causing wires 36 to pull loose from connector body 34. String ties 68 made of a filament material are preferred for their high strength, flexibility, and low cost. However, ties or bands made of metal, plastic, or other materials may also be suitable. The term "tie" used herein is intended to encompass all such means and methods of lashing.

Strain relief member 60 is selectively connected to main housing section 30 in one of a plurality of predetermined discrete, angularly offset positions each defining a corresponding exit path for cable 20 (i.e., cable path). In the configuration of FIGS. 1 and 2, strain relief member 60 is connected to main housing section 30 so as to define a straight cable exit path. FIG. 3 shows, in solid lines, an alternative configuration of housing 66, in which strain relief member 60 is rotated 180° about the axis of cable 20 and 90° relative to main housing section 30 so as to form a right-angle cable exit path (B). The shape and form of mounting flange 54 and strain relief member 60 define the predetermined angularly offset positions of strain relief member 60, which may include in alternative embodiments (not shown) positions other than straight and right-angle positions. For example, mounting flange 54 could be configured to mount strain relief member 60 in more than two possible angularly offset positions. With reference to FIG. 3, it is possible to reconfigure housing 66 between the straight cable exit path position (A), shown in phantom lines, and the right-angle exit path position (B) without disconnecting cable 20 from connector body 34.

FIGS. 4A and 4B are enlarged isometric views of main housing section 30 showing detail of the respective wire-receiving end 56 and terminal end 52 of main housing section 30. With reference to FIGS. 4A and 4B, main housing section 30 includes opposing top and bottom walls 76 and 78 spaced apart by respective left and right side walls 82 and 84. The terms "top," "bottom," "left," and "right," are arbitrary and are not intended to limit the orientation of electrical connector assembly 10 when in use. Walls 76, 78, 82, and 84 of main housing section 30 define and border cavity 48, which is preferably sized to receive at least a portion of connector body 34, as depicted in FIG. 1. Mounting flange 54, which extends from wire-receiving end 56 of main housing section 30, includes a pair of opposing flange walls 86 and 88 extending from opposite sides of an opening 90 in wire-receiving end 56. Flange walls 86 and 88 are preferably planar and parallel. However, in alternative embodiments, the flange walls may be curved, for example to surround a round opening (not shown) in wire-receiving end 56 of main housing section 30. Mounting flange 54 preferably further includes a right side wall 94 spanning between and providing structural support for flange walls 86 and 88. Opening 90 and mounting flange 54 are configured to allow cable 20 or wire to enter main housing section 30 from more than one angularly offset direction, such as the straight (A) and right-angle (B) positions depicted in FIG. 3, for example. Opening 90 may also include multiple separate openings or aperatures, in an alternative embodiment (not shown).

Main housing section 30 may be formed of one piece construction of a die-cast or molded electrically conductive material. Main housing section 30 may also be formed by other methods and with other materials. However, die-cast metal alloys provide desirable durability and shielding against electromagnetic interference (EMI). Suitable conductive materials include zinc alloys such as the widely used ZAMAK-3 alloy (a die-castable zinc alloy including aluminum, magnesium, and copper), aluminum, aluminum alloys, magnesium, magnesium alloys, and others.

Spaced apart around the perimeter of cavity 48 are one or more mounting features 98, such as holes, indentations, slots, or other easily moldable features, which may be used to orient and/or secure connector body 34 to main housing section 30. After molding of main housing section 30, a pair of mounting holes 102 and 104 formed in flange walls 86 and 88, respectively, may be tapped to add threads for screws 64 (FIG. 2).

FIGS. 5A and 5B are first and second enlarged isometric views of strain relief member 60 of FIGS. 1–3. With reference to FIGS. 5A and 5B, strain relief member 60 includes a neck portion 110 extending in a direction away from a nesting flange 114 sized to fit and mate with mounting flange 54 of main housing section 30. Strain relief member 60 includes a passage 118 extending from the region of nesting flange 114 through neck portion 110 and which is sized to admit cable 20 or other wires therethrough, as shown in FIGS. 1–3. Strain relief member 60 is configured to mate with main housing section 30 in one of multiple angularly offset positions relative to main housing section 30. Strain relief member 60 is preferably formed by die-casting or molding of an electrically conductive material, such as ZAMAK-3, zinc alloy, magnesium, magnesium alloy, aluminum, aluminum alloy, or other electrically conductive material.

In a preferred embodiment, nesting flange 114 includes a pair of opposing, generally planar and parallel nesting walls 122 and 124 extending from opposite sides of passage 118. Nesting walls 122 and 124 are sized and spaced to seat in a pair of recesses 126 and 128 formed on mounting flange 54 adjacent flange walls 86 and 88 of main housing section 30. Mounting flange 54 and nesting flange 114 may be configured in a variety of different shapes and configurations. For example, recesses 126 and 128 may be formed on nesting flange 114 and omitted from mounting flange 54. The shape of mounting flange 54 and nesting flange 114 may also be different than shown, provided that the mating sets of walls 86, 88, 122, and 124 are configured to provide a close fit between strain relief member 60 and main housing section 30. Mounting flange 54 and nesting flange 114 preferably overlap and cooperate to surround cable 20 at the junction between main housing section 30 and strain relief member 60, to thereby enhance EMI shielding properties. In a preferred embodiment, nesting flange 114 and mounting flange 54 are dimensioned so that nesting walls 122 and 124 slide snugly against flange walls 86 and 88 to provide a large surface area of electrical contact between strain relief member 60 and main housing section 30, for improved EMI shielding properties.

Nesting flange 114 of strain relief member 60 includes a cover section 134 spanning between nesting walls 122 and 124 and providing structural support therefor. When strain relief member 60 is mounted to main housing section 30, cover section 134 covers an unused portion of opening 90 not intersected by cable 20. For example, with reference to FIG. 3, cover section 134 covers the straight exit path (A) when strain relief member 60 is configured in the right-angle position (B). When strain relief member 60 is in the straight cable exit position (A), as shown in FIG. 1, cover section 134 is positioned opposite right side wall 94 of mounting flange 54 to cover the unused right-angle portion of opening 90. In all of the angularly offset positions, including straight, right-angled, and otherwise, a pair of fastener holes 138 in nesting walls 122 and 124 preferably align with mounting holes 102 and 104 of mounting flange 54 to admit screws 64 which are threaded into threaded mounting holes 102 and 104 for attaching strain relief member 60 to main housing section 30. Other methods and means for fastening or securing strain relief member 60 to main housing section 30 may also be employed. Strain relief member 60 may further include rails 142 and 144 or other projections extending generally away from fastener holes 138. Rails 142 and 144 are sized to seat in a slot 148 (FIG. 4A) formed in wire-receiving end 56 of main housing section 30 adjacent mounting flange 54 and opposite right side wall 94 thereof. The angular position of strain relief member 60 relative to main housing section 30 determines which of the rails 142 and 144 will be seated in slot 148 and which of them will rest adjacent the distal end of right side wall 94 of mounting flange 54. Rails 142 and 144 cooperate with slot 148 and right side wall 94 to prevent rotation of strain relief member 60 relative to main housing section 30 and to provide overlapping regions in housing 66 that further improve EMI shielding. In alternative embodiments (not shown) the rails 142 and 144 may be formed in main housing section 30 while slot 148 may be formed in strain relief member 60, which would be a preferred configuration if recesses 126 and 128 are formed in strain relief member 60 rather than in main housing section 30, as in the alternative embodiment described above (not shown).

Neck portion 110 of strain relief member 60 is preferably cylindrically—shaped for easy insertion inside an end of braided sleeve shield 24 (FIGS. 1 and 2). Braided sleeve shield 24 may be made in accordance with U.S. Federal Specification QQ-B-575, incorporated herein by reference. Neck portion 110 of strain relief member 60 preferably includes a tie slot 158 defined between a pair of spaced apart neck ribs 162 and 164 extending radially from neck portion 110. With reference to FIG. 1, tie slot 158 provides a secure seating region for string tie 68, which secures cable 20 (or other wires or cables) to strain relief member 60. For ease of manufacture of strain relief members 60 and to facilitate a secure connection between strain relief member 60 and cable 20 via string tie 68, neck portion 110 preferably includes a semi-cylindrical section at its distal end between ribs 162 and 164. Rib 162 further defines a second string tie seating region 168 between tie slot 158 and nesting flange 114. A second seating region 168 provides an area around which a shield tie 174 (FIGS. 1 and 3) may be wrapped to secure braided sleeve shield 24 to strain relief member 60 in close electrical contact for EMI shielding purposes. Braided sleeve shield 24 may be further secured to cable 20 with additional ties 176, one or more of which may hold braided sleeve shield 24 tightly against an exposed section of braided sheath 42 for providing good electrical contact and EMI shielding. In alternative cable assemblies (not shown), the braided sheath 42 of cable 20 may be large enough or stretchable enough to be pulled around neck portion 110 and secured to neck portion via a string tie, strap, or other tie at second seating region 168. In some applications, such use of the cable's braided sheath 42 may eliminate the need for a separate braided sleeve shield 24.

FIG. 6 is an enlarged isometric view of a second embodiment strain relief member 60' including an angled neck portion 110' that extends in a direction angularly offset relative to nesting walls 122' and 124' and cover section 134'. In particular, angled neck portion 110' may be angularly offset 15° relative to the plane of cover portion 134', for example. The availability and interchangeability of alternative modular strain relief members such as second embodiment 60' provides further flexibility that allows electrical connector assembly to be used in a wide variety of end use applications and required configurations.

FIGS. 7A and 7B are pictorial views of yet another alternative embodiment housing 66" shown in respective right-angle and straight cable path configurations. With reference to FIGS. 7A and 7B, housing 66" includes a main housing section 30" to which a strain relief member 60" is attached. Strain relief member 60" includes a neck portion 110" having a single annual radially extending rib 180 at a distal end 182 of neck portion 110". Neck portion 110" further includes a tie slot comprised of a pair of opposing slot-shaped openings 186 and 188 into which a string tie (not shown) or other strap may be seated to secure cable or wire to strain relief member 60".

It will be obvious to those having skill in the art that many changes may be made to the details of the above-described embodiments without departing from the underlying principles of the invention. The scope of the present invention should, therefore, be determined only by the following claims.

The invention claimed is:

1. A housing for an electrical connector from which at least one wire extends, comprising:

a main section having a terminal end sized to receive at least a portion of the electrical connector and a wire-receiving end opposite the terminal end, the wire-receiving end including a mounting flange extending away from the terminal end; and a strain relief member including a passage sized to admit the wire therethrough, the strain relief member selectively mountable to the mounting flange of the main section in one of a plurality of discrete, angularly offset positions each defining a corresponding exit path for the wire.

2. A housing according to claim 1 wherein the strain relief member includes a second flange sized and shaped to mate with the mounting flange of the main section.

3. A housing according to claim 1 wherein the plurality of discrete, angularly offset positions include a first position defining a straight exit path for the wire and a second position defining a right-angle exit path for the wire.

4. A housing according to claim 1 wherein the strain relief member includes a tie slot for receiving a tie used to secure the wire to the strain relief member.

5. A housing according to claim 1 wherein:

the main section includes an opening opposite the terminal end through which the wire passes; and the mounting flange includes a pair of opposing flange walls extending from opposite sides of the opening.

6. A housing according to claim 5 wherein the flange walls are parallel.

7. A housing according to claim 5 wherein the strain relief member includes an opposing pair of nesting walls sized and spaced to nest with the flange walls.

8. A housing according to claim 7 wherein the nesting walls are secured to the flange walls with a screw.

9. A housing according to claim 7 wherein the nesting walls cooperate with the flange walls to surround the wire and shield the electrical connector from electro-magnetic interference.

10. A housing according to claim 9 wherein the main section and the strain relief member are cast or molded of an electrically conductive material.

11. An electrical connector assembly, comprising:

a main housing having a terminal end and a cable-receiving portion opposite the terminal end, the cable-receiving portion including a mounting flange extending away from the terminal end; and a strain relief member including a passage sized to admit a cable therethrough, the strain relief member selectively mountable to the mounting flange of the main housing in one of a plurality of predetermined angularly offset positions each defining a corresponding cable path for the cable.

12. An electrical connector assembly according to claim 11 wherein the strain relief member includes a second flange sized and shaped to mate with the mounting flange of the main housing.

13. An electrical connector assembly according to claim 11 wherein the plurality of angularly offset positions include a first position defining a straight cable path and a second position defining a right-angle cable path.

14. An electrical connector assembly according to claim 11 wherein the strain relief member includes a tie slot for receiving a tie used to secure the cable to the strain relief member.

15. An electrical connector assembly according to claim 11, further comprising a connector body to which the cable is terminated, and wherein:

the main housing is coupled to the connector body; and the strain relief is selectively reconfigurable between at least two angularly offset positions relative to the main housing without decoupling the main housing from the connector body.

16. An electrical connector assembly according to claim 11 wherein:

the cable-receiving portion of the main housing is shaped to define an opening that allows the cable to enter the main housing from a plurality of angularly offset directions, the opening including an unused portion defined by the position of the strain relief member when mounted to the mounting flange; and the strain relief member includes a cover section extending over the unused portion of the opening.

17. An electrical connector assembly according to claim 11 wherein:

the cable-receiving portion of the main housing is shaped to define an opening in the main housing sized to admit the cable; and the mounting flange includes a pair of opposing flange walls extending from opposite sides of the opening.

18. An electrical connector assembly according to claim 17 wherein the flange walls are parallel.

19. An electrical connector assembly according to claim 17 wherein the strain relief member includes an opposing pair of nesting walls sized and spaced to nest with the flange walls.

20. An electrical connector assembly according to claim 19 wherein the nesting walls are secured to the flange walls with a screw.

21. An electrical connector assembly according to claim 19, further comprising a connector body to which the cable is terminated, and wherein:

the main housing supports the connector body; and the nesting walls cooperate with the flange walls to surround the cable and shield the connector body from electro-magnetic interference.

22. An electrical connector assembly according to claim 21 wherein the main housing and the strain relief member are cast or molded of an electrically conductive material.

23. An electrical connector assembly for terminating a cable or wire, comprising:

a main housing having a terminal end and a wire-receiving end opposite the terminal end, the main housing including an opening in the wire-receiving end that is sized and shaped to allow the cable or wire to enter the main housing from a plurality of angularly offset directions; and a strain relieving member including a passage sized to admit the wire or cable therethrough, the strain relieving member selectively mounted to the main housing in one of a plurality of predetermined angularly offset positions each defining a corresponding cable path for the cable or wire and an unused portion of the opening, the strain relieving member including a cover section extending over the unused portion of the opening.

24. An electrical connector assembly according to claim 23 wherein the main housing and the strain relieving member are cast or molded of an electrically conductive material.

25. An electrical connector assembly according to claim 23 wherein the plurality of predetermined angularly offset positions include a first position defining a straight cable path and a second position defining a right-angle cable path.

26. An electrical connector assembly according to claim 23 wherein the strain relieving member includes a tie slot for receiving a tie used to secure the cable or wire to the strain relieving member.

27. An electrical connector assembly according to claim 23, further comprising a connector body to which the cable or wire is terminated, and wherein:

the main housing is coupled to the connector body; and the strain relieving member is selectively reconfigurable between at least two angularly offset positions relative to the main housing without decoupling the main housing from the connector body.

28. An electrical connector assembly according to claim 23 wherein:

the main housing includes a mounting flange extending from the wire-receiving end and away from the terminal end of the main housing; and the mounting flange includes a pair of opposing flange walls extending from opposite sides of the opening.

29. An electrical connector assembly according to claim 28 wherein the strain relieving member includes an opposing pair of nesting walls sized and spaced to nest with the flange walls.

30. An electrical connector assembly according to claim 29, further comprising a connector body to which the cable or wire is terminated, and wherein:

the main housing supports the connector body; and the nesting walls and cover section cooperate with the mounting flange to surround the cable or wire and to shield the connector body from electro-magnetic interference.

* * * * *